United States Patent [19]

Fulton

[11] 4,274,355

[45] Jun. 23, 1981

[54] CONVERTIBLE BULWARK AND RAMP SYSTEM FOR MARINE VESSELS

[76] Inventor: George G. Fulton, 8514 46th St. W., Tacoma, Wash. 98466

[21] Appl. No.: 146,477

[22] Filed: May 6, 1980

[51] Int. Cl.[3] ..... B63B 35/18

[52] U.S. Cl. ..... 114/255

[58] Field of Search ..... 114/255, 60, 70, 259, 114/262, 72; 414/480, 537

[56] References Cited

U.S. PATENT DOCUMENTS

| | | | |
|---|---|---|---|
| 3,205,845 | 9/1965 | Slingelandt | 114/255 |
| 3,280,777 | 10/1966 | Matzer | 114/70 |
| 4,158,416 | 6/1979 | Podesta | 114/72 |

FOREIGN PATENT DOCUMENTS

| | | | |
|---|---|---|---|
| 33929 | 11/1964 | Fed. Rep. of Germany | 114/255 |
| 1170873 | 9/1958 | France | 114/72 |
| 39965 | 10/1924 | Norway | 114/255 |
| 121768 | 4/1971 | Norway | 114/72 |
| 1014691 | 12/1965 | United Kingdom | 114/72 |

*Primary Examiner*—Trygve M. Blix
*Assistant Examiner*—John C. Paul
*Attorney, Agent, or Firm*—Christensen, O'Connor, Johnson & Kindness

[57] ABSTRACT

A convertible panel system is disclosed that permits conversion of a fishing vessel for different types of fishing and for different stages of fishing of a given type. In the ramp-forming setting of horizontally interconnected panels, a gear-hauling ramp is formed accessible though an opening in the hull and overlying bulwark. Normally in position to cover the reentrancy in hull and deck, the convertible panel system includes a multiple part deck-forming panel that is folded into stowed position beneath the downwardly swing bulwark panel functioning to provide the ramp surface.

7 Claims, 4 Drawing Figures

CONVERTIBLE BULWARK AND RAMP SYSTEM FOR MARINE VESSELS

BACKGROUND OF THE INVENTION

This invention relates to improvements in fishing vessels and, more particularly, multiple use fishing vessels such as may be converted to different kinds of fishing operations when authorized fishing seasons terminate and new ones commence. In this way, it becomes feasible to make the necessary investment in modern-day vessels sufficiently large and well equipped to operate safely and efficiently in such areas, for example, as in the Bering Sea for king crabs, tanner crabs, salmon and bottom fish. The invention is herein illustratively described by reference to the presently preferred embodiment thereof as applied to a convertible king crabber/-trawler vessel or to a convertible gill netter/longliner vessel. However, it will be recognized that certain modifications and changes with respect to details may be made without departing from the essential features involved.

More particularly, the present invention concerns a novel combination convertible bulwark and ramp system and operating means by which the requirements of structural integrity, faired surfaces, convenience and ease of convertibility are satisfied along with those of uncomprising effectiveness of configuration suiting the functional needs of the vessel in each of the conversion modes of the system. For instance, in one setting, the ramp-forming panel is moved into an upright position wherein it forms an upward continuation of the hull and a transverse continuation of the bulwark and rail structure with no parts protruding either outwardly or inwardly of the bulwark which would catch on gear being lowered or manipulated over the side of the vessel, or over the transom, when the structure is located in the transom. At the same time, and in the same setting, multiple parts of a foldable deck-forming panel that lie stowed in mutually superposed positions beneath the ramp-forming panel in the latter's ramp-forming position now become mutually extended as deck-forming sections locked in place, and safely and conveniently useable as part of a continuous deck of the vessel. In crab fishing, this is the setting of the parts and it is possible then to stack crab pots on the deck, to unload those pots, to work over the catch spilled on deck, and to perform any other operation requirements requiring a continuous deck and a continuous bulwark adjoining that deck. The same conversion is useful after hauling a trawl net or gill net up the ramp when the net is to be unloaded on the deck and the catch sorted and processed for stowage.

In the alternate setting, the deck-forming panels fold into compactly stowed relationship beneath the bulwark panel, now inclined inwardly as a ramp-forming panel.

Simple direct operating means, such as hydraulic jacks, may be used to move the parts between the two settings and latches may be provided to safely lock the parts in the deck-forming position, whereas in the alternative ramp-forming position, the parts rest directly and securely on structural parts formed in a hull reentrancy to accommodate them in that setting.

While convertible vessels for fishing and the like have been proposed heretofore, problems with parts protruding and with difficult or awkward mechanical arrangements have discouraged their practical use. The principal object of this invention is to overcome such problems while satisfying the purposes and requirements first set forth herein.

SUMMARY OF THE INVENTION

As herein disclosed, the invention comprises, in combination with a marine vessel, a ramp-forming panel hinged on a horizontal axis in the hull, preferably at or near the water line of the vessel, so as to permit swinging it between an inwardly and upwardly inclined ramp-forming position where its upper edge substantially merges with or terminates at deck level, and a bulwarkforming upright position where it serves as a continuation of the hull and bulwark of the vessel, typically in a stern transom hull. Hingedly connected between the deck structure of the vessel forwardly of the transom and the inside of the ramp-forming panel at an intermediate height level on the latter, is a foldable deck-forming panel. The deck-forming panel in collapsed or stowed position lies nested beneath the deck-forming panel with the latter in its inclined or ramp-forming position. Hydraulic actuator means connected to the multiple part deck-forming panel can be operated to raise the linkage structure represented by the interconnected panels and parts of panels in a continuous motion which raises the ramp-forming panel into its upright bulwark position and conjointly therewith raises and unfolds the deck-forming panel into its extended position with the parts substantially coplanar with the deck of the vessel. In the latter position, latches may be operated to hold the parts firmly in place.

These and other features, objects and advantages of the invention will become more fully evident from the following description with reference to the accompanying drawings.

DETAILED DESCRIPTION

Figure 1:
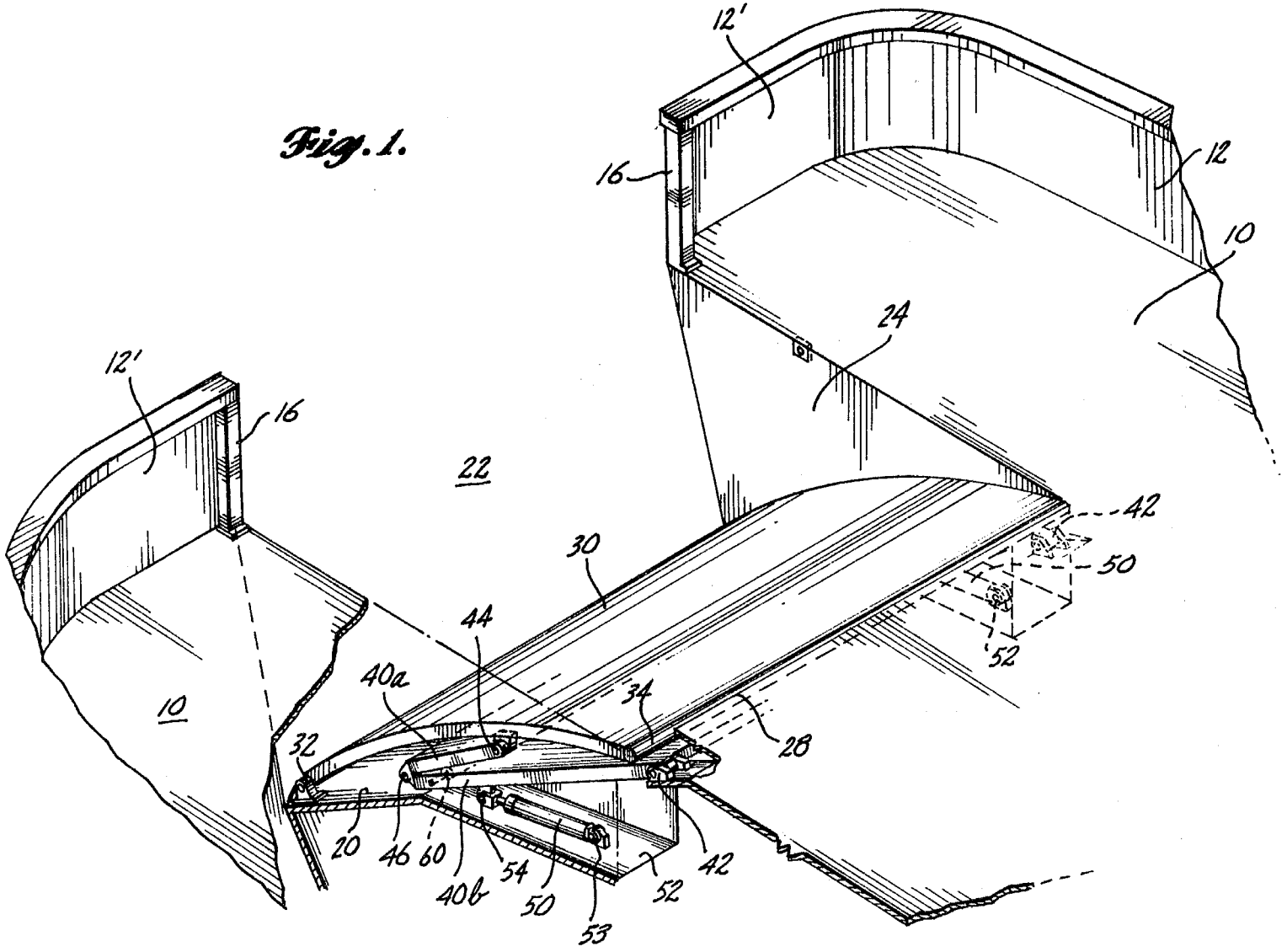
FIG. 1 is a top perspective view of the stern portion of a fishing vessel in which the invention is installed, the parts being in the ramp-forming position.

With reference to the drawings, the vessel, which may comprise a large king crab fishing vessel in the 120 foot to 130 foot size range with a beam of 30 feet or more, includes a steel deck 10 adjoined by surrounding bulwark 12. The vessel's hull in this example has a transom or transverse portion 14 across the stern. At the stern, the bulwark 12 extending aft along the sides of the hull turns transversely and extends part way across the stern in sections 12', which are interrupted by an opening or gap at stanchions or posts 16, separated by approximately one-half the width of the stern. The gap extends downwardly into the hull to a level 18 which represents the juncture of the transom panel 14 and the bottom wall 20 of a hull reentrancy 22. The sides of the reentrancy in the hull 24 are joined at their top edges to deck 10 as by welding, and similarly at their bottom edges to the reentrancy bottom 20 which, in turn, is welded at 18 to transom panel 14. Preferably, the reentrancy bottom panel 20 extends at an upward incline from the edge 18 to join the deck 10 at line 28 at a constant slope of approximately 35°.

The hull reentrancy 42 region lying immediately above the bottom panel 20 thereof accommodates the ramp-forming panel 30 in its two functional settings and clears it for motion between those settings as depicted. In the ramp-forming setting of FIGS. 1 and 3, panel 30, mounted in the hull by hinge means 32 to swing about a horizontal axis located near water level, overlies the reentrancy panel 30 and forms a sloping ramp leading upwardly from the edge 18 to deck level at 28. The upper edge of panel 30, terminating in a rail bar 34, thereby provides a continuous smooth and faired surface for drawing a net N or longlines with floats, etc. upwardly onto the deck of the vessel through the hull opening formed by the bulwark and hull opening in the stern transom.

Figure 2:
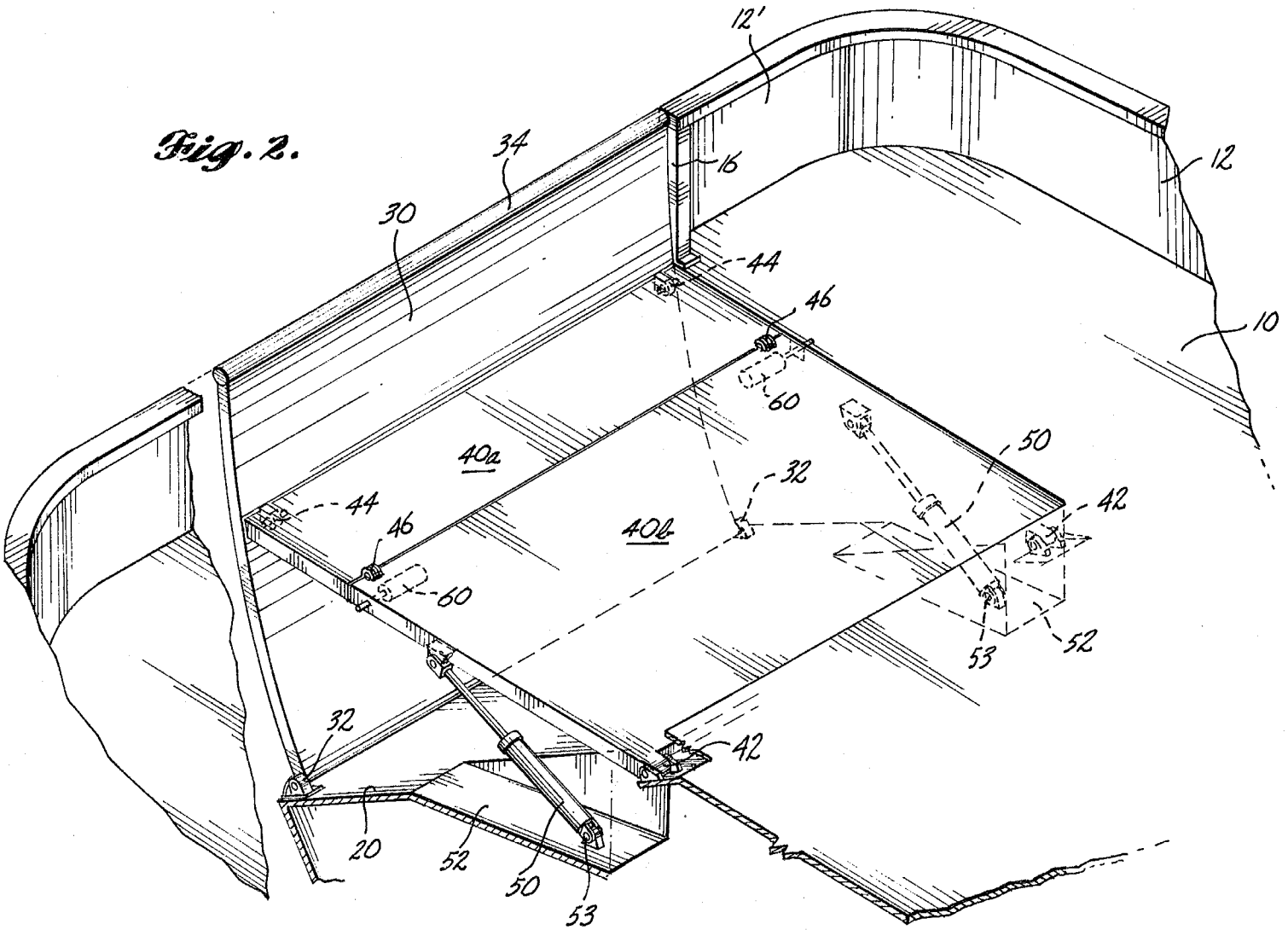
FIG. 2 is a similar view in which the parts are in the deck-forming position wherein the ramp-forming panel becomes a continuation of the transom bulwark of the vessel.
Figure 4:
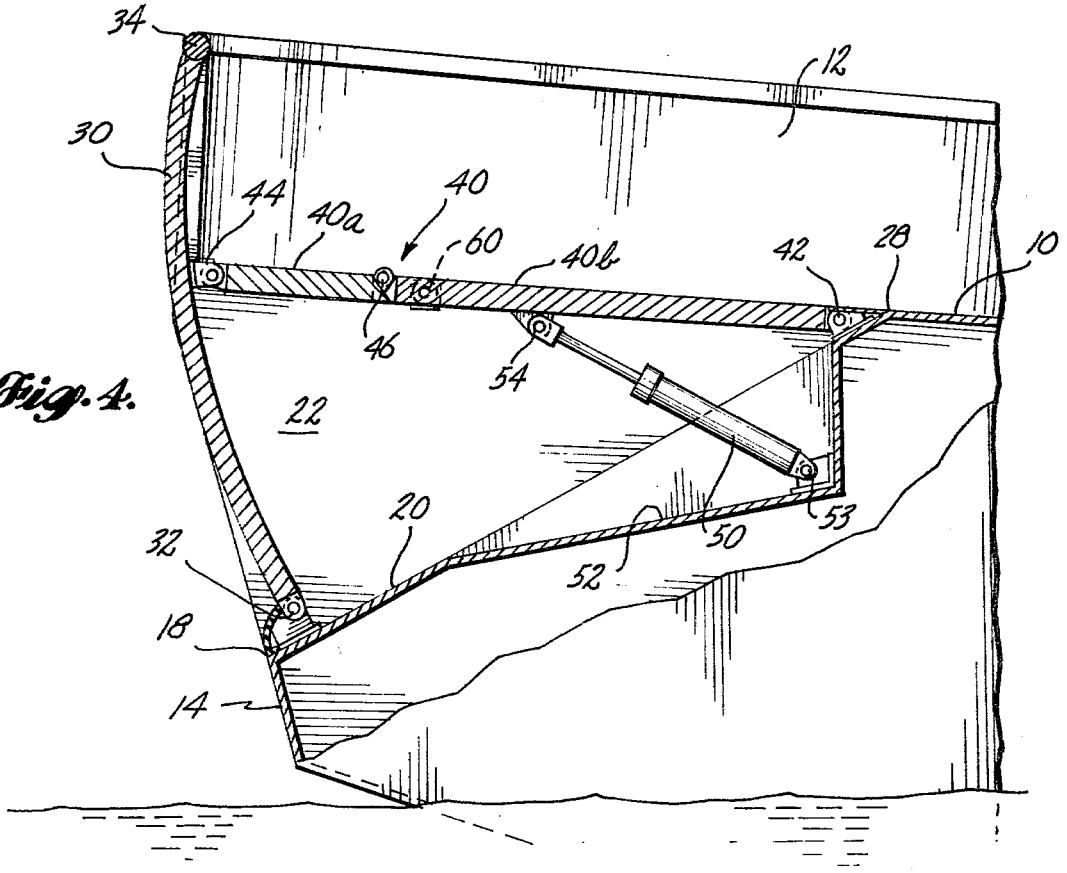
FIG. 4 is a view similar to FIG. 3 with the parts in the setting shown in FIG. 2, namely the deck-forming position, with the ramp now a portion of the bulwark and hull transom.
Figure 3:
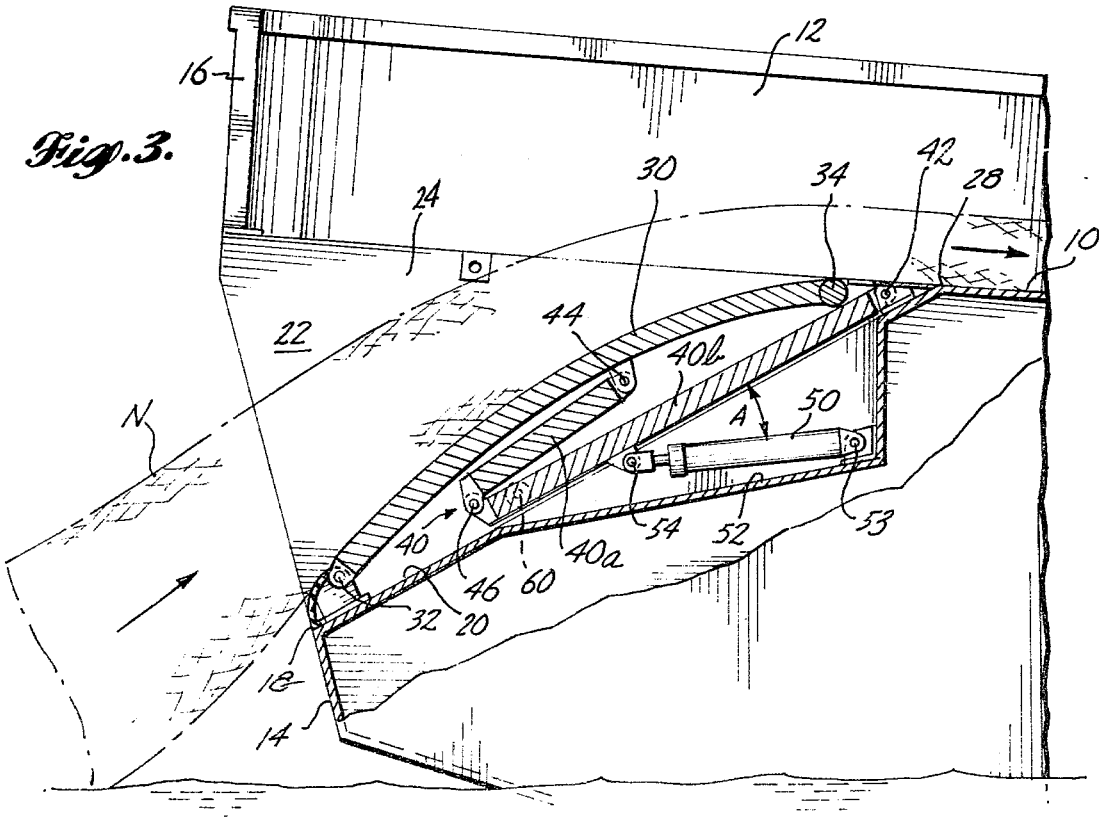
FIG. 3 is a sectional side elevation of the stern portion of the vessel with the parts set as in FIG. 1 and illustrating a trawl net being hauled aboard by way of the ramp.

In the bulwark-forming position of the panel 30, as shown in FIGS. 2 and 4, panel 30 serves as a continuation of the bulwark sections 12' and also as an upward and transverse continuation of the hull transom 14 to keep the seas from washing up and over the deck and to provide a continuous protective bulwark across the full width of the stern deck. In this setting, there is a multiple-part deck-forming panel 40 mounted by hinge means 42 to the deck structure at location 28 and at its opposite, parallel edge is connected by hinge means 44 to the ramp-forming panel 30 at an intermediate height level on the latter. The location of the hinge means 44 is chosen so that with the panel parts **40*a* and 40*b* coextended in the unfolded position, they will form a continuation of deck 10. The two panel parts 40*a* and 40*b* are interconnected by hinge means 46 to permit them to fold together in mutually superposed positions nested beneath the ramp-forming panel 30 with the latter in its ramp-forming position (FIG. 3**).

In order to actuate the combination of panels as a coordinated linkage, dual hydraulic jacks 50 are mounted in hull reentrancy pockets 52 adjacent transversely opposite sides of the panel system. Each jack 50 is pivotally connected at 52 to the hull structure in the forward lower corner of the associated pocket 52 and is pivotally interconnected by its opposite end at 54 to the under side of the deck-forming part **40*b*, at 54. The relative lengths fore and aft of the vessel of the panel 50*b* and of the hydraulic jacks 50 in their extended and retracted positions are such that mechanical advantage is available to move the panel system directly into an erected bulwark-forming and deck-forming position by extension of the jacks. Thus, as shown in FIG. 3, the panel part 40*b* overlying the jacks 50 in the stowed position form an acute angle A therewith of sufficient magnitude that extension of the jacks will create torque about the pivot hinges 42 of the panel part 40*b* so as to swing the latter upwardly and thereby so as to cause the ramp-forming panel 30 to swing upward and aft toward bulwark-forming position as shown in FIG. 4. The relationship remains favorable to mechanical action all the way into the fully erected position wherein the deck-forming panel 40 is coplanar with the deck, as will be seen from FIG. 4**.

In the erected position, wherein the panel 40 is flush with the deck and forms a part thereof, hydraulically actuated locking pin devices 60 may be extended so as to lock the parts in the indicated position. These can be retracted when it is desired to lower the deck-forming panel and swing the ramp-forming panel into its ramp-forming position. At that time, and during that action, it may or may not be necessary to apply reverse hydraulic force to the jack 50 depending upon weight loads designed into the system. For example, it is possible merely to use the hydraulic jacks 40 in the reverse motion, wherein the parts move from the position shown in FIG. 4 to the position shown in FIG. 3 as hydraulic pots or retarding devices. Once the parts are lowered to the position shown in FIG. 3, the arrangement allows gravity to maintain one part resting upon the other in a firm and settled relationship which needs no locking mechanism to hold the parts in place.

Preferably, the ramp-forming panel 30 is convexly curved, that is, so that it forms an upwardly arched ramp in its ramp-forming position (FIG. 3), and so that it forms a convex-outward curved conventional hull transom configuration approximately hull/bulwark contour in the erected setting depicted in FIG. 4.

It will be evident that the principles of the invention may be implemented with the parts designed in varying proportions and in varying locations along the sides or transom portion of the vessel's hull, depending upon application, upon associated equipment location and address orientation or positioning thereof on the vessel, and, of course, upon individual operator or designer preference. Therefore, the novel principles are not necessarily confined to details of the illustrated embodiment, but are intended to be interpreted in accordance with the claims that follow.

The embodiments of the invention in which an exclusive property or privilege is claimed are defined as follows:

1. In a marine vessel, the combination comprising a hull-bulwark panel having a generally horizontal lower edge hinged in the hull below deck level to permit swinging said panel between an upright bulwark-forming position projecting above deck level and a sloping ramp-forming position projecting inwardly of the hull and upwardly at an incline substantially to deck level, a foldable multi-part deck-forming panel having substantially parallel opposite edges, a first such edge hingedly connected to the bulwark panel at an intermediate height level on the latter and a second such edge hingedly mounted on the vessel to swing vertically on an axis that is substantially at deck level, parallel to and spaced inwardly from the bulwark panel's hinge axis, said deck-forming panel being unfolded with its parts coextending in substantially planar relationship at deck level with the hull-bulwark panel in its upright bulwark-forming position and being stowed with its parts folded one over another beneath the hull-bulwark panel in its ramp-forming position, and operating means to move the panels between such positions.

2. The combination defined in claim 1, wherein the hull of the vessel adjoining such hull-bulwark panel is formed with a reentrancy having an inwardly extending lower wall portion interconnecting inwardly extending upright opposite side portions that are joined to the vessel's deck, and accommodating the movable panels in the different positions thereof.

3. The combination defined in claim 2, wherein the hull-bulwark panel is convex outward in vertical planes so as to form an upwardly arched ramp in its ramp-forming position.

4. The combination defined in claim 3, wherein the operating means comprises hydraulic jack means mounted in below-deck position and operatively connected to the deck-forming panel.

5. The combination defined in claim 4, wherein the hydraulic jack means comprises at least two piston-cylinder jacks each recess mounted in the deck of the vessel and each pivotally connected by one end to the part of the deck-forming panel hingedly mounted on the vessel and by its opposite end to the vessel at a location spaced sufficiently below the hinged second edge of the deck-forming panel to dispose the jacks at a vertical angle to the folded panel so as to effectively elevate the same toward unfolded position by operation of such jacks.

6. The combination defined in any of claims 1–5, wherein the marine vessel comprises a fishing vessel having a transom stern including a bulwark extending upwardly from the hull above deck level across the stern including the hull-bulwark panel in its bulkwark-forming position, said panel comprising a minor fractional part of the stern width, thereby providing, in its ramp-forming position, a transversely centered ramp for inhauling of fishing gear through the stern and up onto the deck of the vessel.

7. The combination defined in any of claims 1–5, wherein the marine vessel comprises a fishing vessel having a transom stern with the claimed combination incorporated therein intermediate opposite sides of the vessel.

* * * * *

UNITED STATES PATENT AND TRADEMARK OFFICE

CERTIFICATE OF CORRECTION

PATENT NO. : 4,274,355

DATED : June 23, 1981

INVENTOR(S) : George G. Fulton

It is certified that error appears in the above-identified patent and that said Letters Patent are hereby corrected as shown below:

Title page, introductory information: "May 6, 1980" is changed to --May 5, 1980--.

Title page, Abstract: "though" is changed to --through--.

Column 2, line 13: "bulwarkforming" is changed to --bulwark-forming--.

Signed and Sealed this

*Twenty-second* Day of *September 1981*

[SEAL]

*Attest:*

GERALD J. MOSSINGHOFF

*Attesting Officer* *Commissioner of Patents and Trademarks*